United States Patent [19]

Moranne

[11] 4,324,290

[45] Apr. 13, 1982

[54] HEAT EXCHANGER COMPRISING A CORE OF TUBES ENGAGED INSIDE END PLATES MECHANICALLY CONNECTED WITH HEADER BOXES

[75] Inventor: Jean-Pierre Moranne, Saint-Leu-La-Foret, France

[73] Assignee: Societe Anonyme des Usines Chausson, Asnieres, France

[21] Appl. No.: 200,986

[22] Filed: Oct. 27, 1980

[30] Foreign Application Priority Data

Nov. 12, 1979 [FR] France ..... 79 27789

[51] Int. Cl.[3] ..... F28F 9/02

[52] U.S. Cl. ..... 165/173

[58] Field of Search ..... 165/76, 173, 175

[56] References Cited

U.S. PATENT DOCUMENTS

| | | | |
|---|---|---|---|
| 3,581,814 | 6/1971 | Jackson | 165/175 X |
| 4,023,618 | 5/1977 | Kun et al. | 165/175 |

FOREIGN PATENT DOCUMENTS

| | | | |
|---|---|---|---|
| 2353405 | 4/1975 | Fed. Rep. of Germany | 165/173 |
| 2353442 | 4/1975 | Fed. Rep. of Germany | 165/173 |
| 2449045 | 7/1975 | Fed. Rep. of Germany | 165/173 |
| 2703528 | 8/1978 | Fed. Rep. of Germany | 165/76 |
| 2247692 | 5/1975 | France | 165/173 |
| 7416284 | 12/1975 | France | 165/173 |
| 699032 | 10/1953 | United Kingdom | 165/173 |
| 1443725 | 7/1976 | United Kingdom | 165/173 |

*Primary Examiner*—Sheldon J. Richter

*Attorney, Agent, or Firm*—Kirschstein, Kirschstein, Ottinger & Cobrin

[57] ABSTRACT

The heat exchanger comprises a core of tubes engaged into tubes plates defining a peripheral groove bounded outwardly by a raised edge with a sealing gasket being placed in the bottom of the groove in order to be clamped by under side of an edge of a header box maintained by gripping means. The header box is thin walled and the edge of said header box has a top portion with a small bar interposed between said top portion and said gripping means.

12 Claims, 6 Drawing Figures

HEAT EXCHANGER COMPRISING A CORE OF TUBES ENGAGED INSIDE END PLATES MECHANICALLY CONNECTED WITH HEADER BOXES

BACKGROUND OF THE INVENTION

The present invention relates to heat exchangers comprising a core of tubes engaged inside end plates which are adapted for being covered by header boxes assembled so as to be dismountable, viz. fixed on the periphery of each tube plate with interposition of a deformable joint.

DISCLOSURE OF THE PRIOR ART

Hitherto, in this type of heat exchangers, the header boxes are made in a moldered synthetic material so that they present, on their lower portion, a heel or edge which is thick and protruding, and on which are crimped lugs or protrusions formed either by the tube plate itself or by an added clip.

However, it was not possible to use the same technique with metallic header boxes since such boxes have necessarily thin walls and, consequently, it is not possible to economically form a thick heel permitting an efficient crimping operation.

In an attempt to solve this problem, British Pat. No. 699,032 has disclosed embodiments in which the peripheral edge of the header box is crimped on a flexible gasket by forming a hollow rib which is adapted for increasing the rigidity of the crimped edge. This apparently satisfactory disposition needs the use of a complex tooling in order to form the hollow rib inside which is placed the flexible gasket.

Applicant has already described in French Pat. No. 74-16284 an embodiment in which the peripheral edge of the header box has a rounded form for increasing its rigidity and, in this case, the edge of the end plate is crimped on the raised end of the peripheral edge of the header box.

Difficulties have become apparent in practice since the crimping devices used for the lugs of the tube plate inside the curved portion of the peripheral edge of the header box often cause a deformation of the peripheral edge, and, consequently, warp the portion of the peripheral edge which normally bears on the flexible gasket.

SUMMARY OF THE INVENTION

According to the invention, the heat exchanger comprising a core of tubes engaged into tube plates defining a peripheral groove bounded outwardly by a raised edge with a sealing gasket being placed in bottom of the groove in order to be clamped by under side of an edge of a header maintained by gripping means taken among crimping portions extending the raised edge of the tube plates and an added clip, is characterized in that the header box is thin walled and in that the edge of such header box has a top portion with a small bar interposed between said top portion and said gripping means.

Various other features of the invention will become more apparent from the detailed following description.

BRIEF DESCRIPTION OF THE DRAWINGS

Embodiments of the invention are shown, as non limitative examples, in the accompanying drawings, in which.

DESCRIPTION OF THE INVENTION

Figure 1:
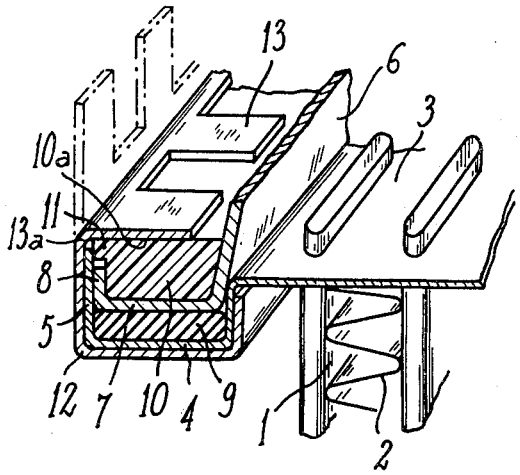
FIG. 1 is a partial perspective view, partly cut away of a heat exchanger carrying out the invention.

In the drawings, reference numeral 1 designates the circulation tubes of a heat exchanger, particularly a cooling exchanger of the type of those used in motor vehicles. The tubes 1 are connected together in the usual manner by secondary heat exchange elements 2, made for instance of corrugated bands or fins.

The ends of the tubes 1 are engaged in tube plates 3 which are formed, on their periphery, with a groove 4 and an outer raised edge 5. The tube plates 3 of the heat exchanger are made of a metal or an alloy compatible with the metal or alloy of the tubes 1 and of the elements 2, and these parts are assembled into a unit by brazing of by any other suitable method.

According to the invention, there is used for covering the tube plates 3 a thin walled header box 6, advantageously made of metal, and typically by stamping a sheet of metal. Although not shown, the header box comprises in a known manner pipes, bases and other ducts which are usual in the art.

In FIG. 1, the header box is formed at its base with a peripheral edge 7 the width of which corresponds to that of the groove 4 of the tube plate 3, and the edge 7 is extended by a raised edge 8, particularly for rigidifying said raised edge 8.

For positioning the header box 6 and providing tightness with the tube plate, there is proceeded as follows:

First of all, a deformable sealing gasket 9 is placed in the bottom of the groove 4, then the header box 6 is placed on said gasket. A following operation consists in positioning, between the raised edge 8 and the peripheral wall of the header box 6, a small bar 10 which may be made of various materials but which must be, preferably, rigid and not or little deformable, taking in account the efforts it has to withstand. Synthetic resins of the polyamide type may be used for making the small bar which could, also, be made of metal.

It is advantageous, as shown in the drawings, that the small bar 10 forms a shoulder 11 covering the top portion of the raised edge 8 of the box.

The following operation consists in positioning gripping means constituting a clip 12, well known as such, encasing the bottom of the portion of the tube plate which forms the groove 4 and which extends along the raised edge 5, and the lugs 13 of which are crimped on the top of the small bar 10.

It is advantageous that the small bar extends on the four sides of the tube plate. Moreover, the top 10*a* of the small bar is preferably situated above the edge of the tube plate so that the fold 13*a* of the lugs does not generate a fatigue line.

Figure 3:
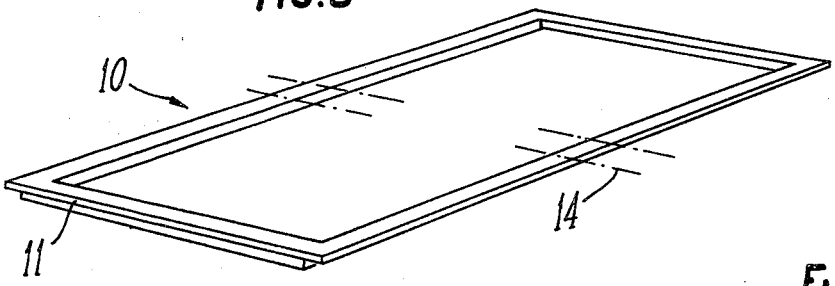
FIG. 3 is a perspective view of a particular member used for practicing the invention.

Since the tube plates are most usually of a uniform width, it is advantageous, as shown in FIG. 3, to make the small bars 10 by a molding technique; the bars having the shape of a rectangular frame the dimensions of which correspond to those of the largest tube plate able to be used, and said small bars in the shape of a rectangular frame are then cut to lengths, as shown for example by the cutting lines 14 in FIG. 3. Of course it is possible, in case of need, to form small bars in the shape of rectangular frames for each type of heat exchanger, and it would not be departed from the scope of the invention by manufacturing half-frames the sides of which would then be cut to lengths, or by using lengths of small bars which would be placed in the four sides of the groove of each tube plate.

Figure 2:
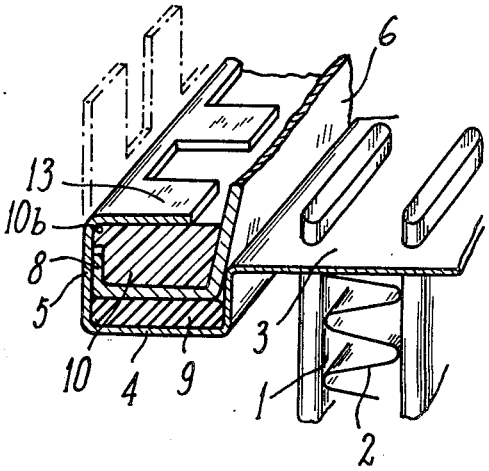
FIG. 2 is a partial perspective view similar to FIG. 1, of a first alternative embodiment.

FIG. 2 illustrates a slight alternative embodiment according which the clip 12 is not used. In this case, it is the raised edge 5 of the tube plate which is provided with lugs 13, crimped on the top of the small bar 10 to constitute a gripping means. In this embodiment, the edge 10*b* at least of the small bar is rounded so that the fold of the lugs 13 is made in good conditions.

Figure 4:
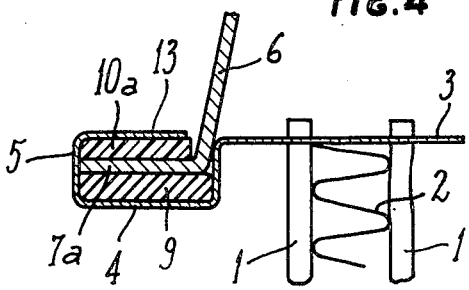
FIG. 4 is a partial cross-sectional view illustrating a second alternative embodiment of the invention.

FIG. 4 illustrates a simplified embodiment according which the header box 6 has no raised edge 8, as in the previous embodiments, but is only surrounded by a plane edge 7*a*. In this case, there is, as previously, positioned on the top portion of the edge a small bar 10*a* the width of which corresponds to that of the edge 7*a*, and the lugs 13*a* of the tube plate 3 are crimped as shown in FIG. 2 on the top portion of the small bar to act as a gripping means.

In this embodiment, the clip 12 of FIG. 1 could be used in the same way.

Figure 5:
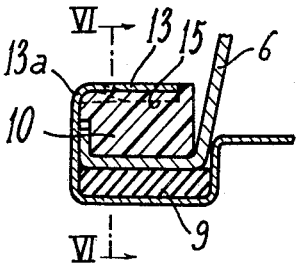
FIG. 5 is a cross-sectional view illustrating a development of the invention.
Figure 6:
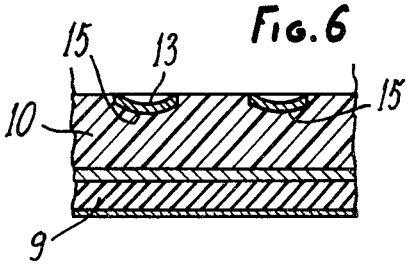
FIG. 6 is a cross-sectional view taken along line VI—VI of FIG. 5.

FIGS. 5 and 6 show a development of the invention which is practiced in the embodiment hereabove described with reference to FIG. 2 but which, obviously, is applicable to the other embodiments. According to this development, curved-bottom notches, for example notches of a concave shape, are formed in the small bars and the lugs 13 are folded over in the notches and deformed so as to mate the shape of the bottom of said notches, which increases considerably the stiffness of the lugs.

In all cases, the small bar which is made of a hard material withstands the efforts due to the crimping operation and distributes the efforts on the edge 7 or 7*a* of the header box, said edge being thus applied under a uniform pressure on the sealing gasket 9.

The invention is not restricted to the embodiments shown and described in detail, and various modifications may be carried out without departing from the scope of the invention as shown by the appending claims.

Particularly, the header boxes can be made of a synthetic material while having a thin wall normally deformable under the influence of the force usually applied by the lugs 13 if the small bars 10 were not used. It is thus possible to manufacture header boxes at costs lower than those entailed by boxes made of a molded synthetic material the thickness of which has to prevent any deformation of the part which is applied on the gasket 9 by the lugs 13.

What is claimed is:

1. A heat exchanger of the type including a core of tubes (1) engaged in tube plates (3) that have a peripheral groove (4) bounded outwardly by a raised edge (5), with a sealing gasket (9) on the bottom of the groove in order to be clamped by under side of an edge of a header box (6) maintained by gripping means (13), characterized in that the header box is thin walled and in that the edge of said header box has a top portion with a small bar (10) interposed between said top portion and said gripping means.

2. A heat exchanger according to claim 1, wherein said gripping means are crimping portions extending the raised edge of the tube plates.

3. A heat exchanger according to claim 1, wherein said gripping means is an added clip.

4. A heat exchanger according to claim 1, wherein the small bar (10) is made of a hard material substantially non deformable with regards to the efforts applied thereto by the gripping means.

5. A heat exchanger according to claim 1, wherein the small bar (10) extends all around the tube plate and the header box which is covering it.

6. A heat exchanger according to claim 1, wherein the small bar (10) is formed by a part having a shape taken among that of a rectangular frame, a half-frame and beads, cross-sectional dimensions of the part corresponding to the groove formed in the tube plate.

7. A heat exchanger according to claim 1, wherein the small bar (10) have a shape taken among that of a rectangular frame and half-frame, said small bar corresponding in dimensions of the largest tube plates used in manufacture, and wherein said small bar is cut in its sides so as to be adapted to tube plates of smaller dimensions.

8. A heat exchanger according to claim 1, wherein the header box (6) is formed, beyond its edge, with a raised portion (8), and wherein the small bar has a thickness which is superior to height of said raised portion by forming a shoulder (11) covering the end of said raised portion.

9. A heat exchanger according to claim 1, wherein at least the edge (10*b*) of the small bar which is turned towards the gripping means is rounded.

10. A heat exchanger according to claim 1, wherein the gripping means are formed by lugs (13) folded over on top of the small bars.

11. A heat exchanger according to claim 10, wherein the small bars are formed, opposite the lugs, with notches (15) having a curved bottom and on which the lugs (13) are applied.

12. A heat exchanger according to claim 11, wherein the curve of the bottom of the notches (15) is of a concave shape.

* * * * *